US005992400A

United States Patent [19]

Meiwes

[11] Patent Number: 5,992,400

[45] Date of Patent: Nov. 30, 1999

[54] GAS DELIVERY SYSTEM OF AN INTERNAL COMBUSTION ENGINE

[75] Inventor: Johannes Meiwes, Markgroeningen, Germany

[73] Assignee: Robert Bosch GmbH, Stuttgart, Germany

[21] Appl. No.: 09/056,872

[22] Filed: Apr. 8, 1998

[30] Foreign Application Priority Data

Apr. 8, 1997 [DE] Germany ..... 197 14 436

[51] Int. Cl.[6] ..... F02B 23/00

[52] U.S. Cl. ..... 123/586

[58] Field of Search ..... 123/585, 586, 123/308

[56] References Cited

U.S. PATENT DOCUMENTS

| | | | |
|---|---|---|---|
| 4,196,701 | 4/1980 | Tamura et al. | 123/586 |
| 4,304,211 | 12/1981 | Tezuka et al. | 123/585 |
| 4,347,816 | 9/1982 | Saito et al. | 123/308 |
| 4,517,941 | 5/1985 | Nakagawa | 123/586 |

FOREIGN PATENT DOCUMENTS

| | | |
|---|---|---|
| 44 00 449 A1 | 9/1994 | Germany . |
| 36 08 522 A1 | 9/1997 | Germany . |
| 2 274 138 | 7/1994 | United Kingdom . |

*Primary Examiner*—Noah P. Kamen

*Attorney, Agent, or Firm*—Edwin E. Greigg; Ronald E. Greigg

[57] ABSTRACT

A gas delivery system in which air supplied to the internal combustion engine via a supplementary conduit is controlled. In the gas delivery system, the main conduit gas flow traveling through the throttle valve conduit is controlled by a throttle valve and the supplementary conduit gas flow flowing through the supplementary conduit is controlled by a supplementary conduit control mechanism. The throttle valve and the supplementary conduit control mechanism is adjusted jointly with one adjusting drive device. The gas delivery system is provided in particular for internal combustion engines of motor vehicles.

18 Claims, 3 Drawing Sheets

GAS DELIVERY SYSTEM OF AN INTERNAL COMBUSTION ENGINE

BACKGROUND OF THE INVENTION

The invention is based on a gas delivery system of an internal combustion engine.

In internal combustion engines, usually a main conduit gas flow is supplied to the combustion chamber or chambers via a main conduit. The main conduit has a relatively large cross section so that when needed, a large main conduit gas flow can be delivered to the combustion chamber or chambers without excessive flow losses. In the course of the main conduit, there is an adjustable main conduit throttle mechanism which controls the main conduit gas flow. The main conduit throttle mechanism is adjusted with the aid of an adjusting drive. The main conduit throttle mechanism is usually a throttle valve. Depending on the type of internal combustion engine in the main conduit gas flow flowing air is supplied to the fuel in the course of the main conduit to the injection valves of each combustion chamber, or the fuel is directly injected into the combustion chamber or chambers.

Because the cross section of the main conduit is relatively large, the flow speed of the main conduit gas flow flowing into the combustion chamber or chambers is quite low under particular operating conditions of the internal combustion engine. Since this can lead to problems in the mixture production and therefore in the combustion progression in the combustion chamber, particularly in the idling range, a supplementary conduit gas flow is delivered into the combustion chamber or chambers via a supplementary conduit. Because the cross section of the supplementary conduit is quite small, the supplementary conduit gas flow in the supplementary conduit has a high flow speed in the region of the inlet conduit into the combustion chamber, even at a relatively low supplementary conduit gas flow in the supplementary conduit, by means of which the mixture production and therefore the combustion progression in the combustion chamber or chambers is improved.

In order to control the supplementary conduit gas flow in the supplementary conduit, a special supplementary conduit control mechanism is provided in the course of the supplementary conduit. In previously known embodiments, the main conduit throttle mechanism and the supplementary conduit control mechanism are each adjusted with the aid of a separate adjusting drive. The other adjusting drive for the supplementary conduit control mechanism requires a considerable expenditure on the whole and the increased costs resulting from this are of considerable disadvantage in the manufacture of gas delivery systems.

OBJECT AND SUMMARY OF THE INVENTION

The gas delivery system of an internal combustion engine embodied according to the invention has the advantage over the prior art that the manufacturing cost is significantly reduced.

Advantageous improvements and updates of the gas delivery system of an internal combustion engine are possible by means of the measures taken in carry out the invention.

The invention will be better understood and further objects and advantages thereof will become more apparent from the ensuing detailed description of preferred embodiments taken in conjunction with the drawings.

DESCRIPTION OF THE PREFERRED EMBODIMENTS

The gas delivery system of an internal combustion engine embodied according to the invention can be used in every engine in which a combustion chamber is intended to be supplied with a main conduit gas flow via a main conduit and a supplementary conduit gas flow via a supplementary conduit. The internal combustion engine can, for example, have only one combustion chamber. The internal combustion engine can also have a number of combustion chambers. The main conduit can be divided into a number of individual conduits, for example before reaching the combustion chambers. The main conduit with the adjustable main conduit throttle mechanism can be embodied so that the adjustable main conduit throttle mechanism controls the gas flow for all the combustion chambers of the internal combustion engine. The gas delivery system, though, can also be embodied so that for example, a separate main conduit with a separate main conduit throttle mechanism is associated with each combustion chamber of the internal combustion engine. At least one of these main conduit throttle mechanisms is then also used to adjust the supplementary conduit gas flow in the supplementary conduit. However, it can also be the case that each of the adjustable main conduit throttle mechanisms is also used to control the supplementary conduit gas flow in the supplementary conduit.

In the following description of exemplary embodiments, for reasons of simplicity, it will be assumed that the internal combustion engine has four combustion chambers and the adjusting drive controls the main conduit gas flow and the supplementary conduit gas flow for the four combustion chambers.

Figure 1:
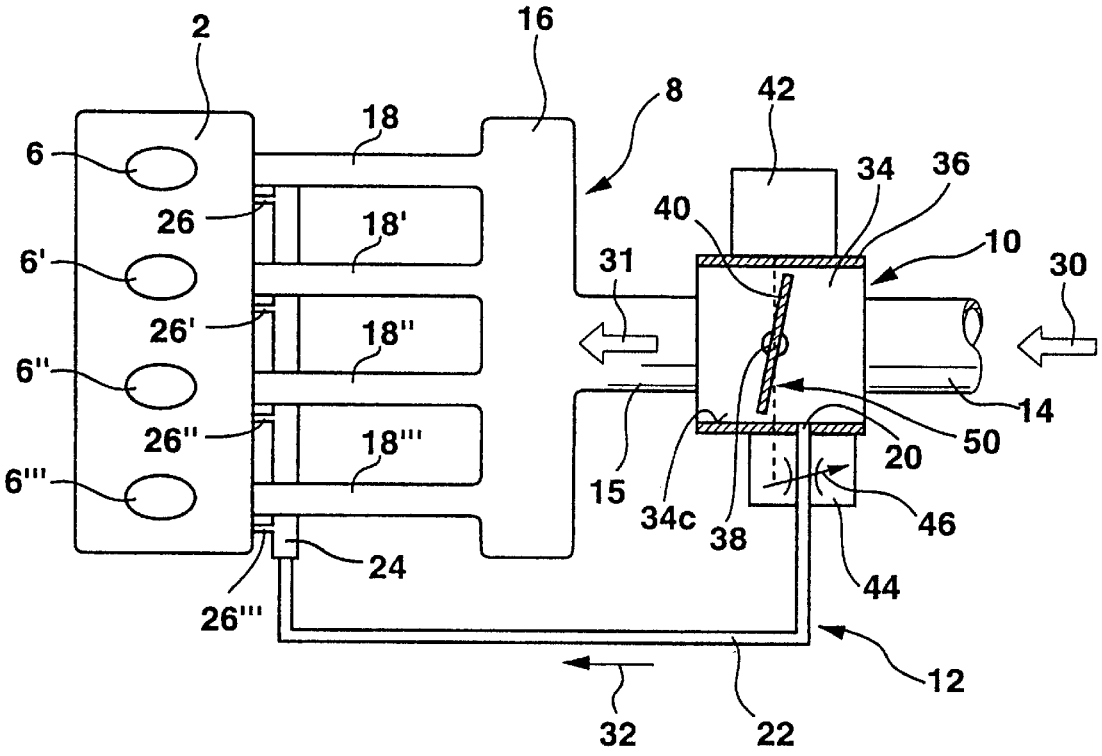
FIG. 1 is a schematic representation of a gas delivery system embodied according to the invention and FIGS. 2 and 3 show different details.

FIG. 1 shows a preferably selected exemplary embodiment in a symbolic form.

FIG. 1 schematically represents an internal combustion engine 2 and a gas delivery system that belongs to the internal combustion engine 2. Inside the internal combustion engine 2, there is a first combustion chamber 6, a second combustion chamber 6', a third combustion chamber 6", and a fourth combustion chamber 6'''. The gas delivery system includes a main conduit 8, a main conduit throttle mechanism 10, and a supplementary conduit 12. The main conduit 8 includes a conduit inlet end 14, the main conduit throttle mechanism 10, a connection 15, and a manifold 16. Viewed in terms of the flow direction, the above-mentioned parts of the main conduit 8 come in the order in which they are mentioned. A first individual conduit 18, a second individual conduit 18', a third individual conduit 18", and a fourth individual conduit 18''' branch from the manifold 16 parallel to one another. The individual conduits 18, 18', 18", 18''' are embodied, for example, as swing pipes in order to be able to achieve the delivery of as great a full-load power as possible with the internal combustion engine 2.

At the transitions from the individual conduits 18, 18', 18", 18''' into the combustion chambers 6, 6', 6", 6''', inlet valves are provided in a known manner, which are not shown in the drawings for the sake of improved clarity. In the course of the main conduit 8 of the gas delivery system, there is, for example, a fuel injection valve or a number of fuel injection valves for the fuel. Likewise for the sake of better clarity, no injection valve is represented in the drawings. The internal combustion engine 2 is preferably embodied so that a fuel injection valve is disposed at the end of each of the individual conduits 18, 18', 18", 18'", which either injects the fuel into the individual conduits 18, 18', 18", 18'" upstream of the inlet valve or injects it downstream of the inlet valves, directly into the combustion chambers 6, 6', 6", 6'". German patent disclosure DE 36 08 522 A1 has disclosed an embodiment in which the fuel injection valves inject the fuel into the individual conduits of the main conduit, upstream of the inlet valves. German patent disclosure DE 44 00 449 A1 and the English publication GB 2 274 138 A each have disclosed an internal combustion engine in which the fuel injection valves inject the fuel directly into the combustion chambers. It is, however, also conceivable that a fuel injection valve is disposed in the region of the conduit inlet end 14, upstream of the main conduit throttle mechanism 10.

In the particularly selected exemplary embodiment, the supplementary conduit 12 contains a supplementary conduit inlet 20, a supplementary conduit guide 22, a so-called turbulence manifold 24, a first turbulence air supply 26, a second turbulence air supply 26', a third turbulence air supply 26", and a fourth turbulence air supply 26'". The supplementary conduit 12 branches off from the main conduit 8 in the region of the main conduit throttle mechanism 10. The supplementary conduit 12 begins at the supplementary conduit inlet 20.

A gas flow 30 flows through the gas delivery system. The gas flow 30 is symbolically depicted in the drawing with an arrow provided with the reference numeral 30. The gas flow 30 is normally flowing air. The gas flow 30, though, can also be a fuel-air mixture, depending on whether the gas flow is considered upstream or downstream of the fuel injection valve, where the flowing air is supplied with fuel. For example, in the region of the main conduit throttle mechanism 10, the gas flow 30 is divided into a main conduit gas flow 31 and a supplementary conduit gas flow 32. The main conduit gas flow 31 flows through the connection 15, through the manifold 16, and through the individual conduits 18, 18', 18", 18'" into the combustion chambers 6, 6', 6", 6'". The supplementary conduit gas flow 32 flows out of the main conduit 8 through the supplementary conduit inlet 20, then through the supplementary conduit guide 22, through the turbulence manifold 24, and through the turbulence air supplies 26, 26', 26", 26'", where the supplementary conduit gas flow 32 is preferably directed right at the inlet valve or valves of the combustion chambers 6, 6', 6", 6'". The arrow 32 is depicted as thinner than the arrow 31 because with the exception of a relatively small main conduit gas flow 30 in the idling range and in the lower partial load range of the internal combustion engine 2, the supplementary conduit gas flow 32 is significantly smaller than the main conduit gas flow 31.

The symbolically depicted main conduit throttle mechanism 10 preferably contains a throttle valve connector 34 with a throttle valve shaft 38 and a throttle valve 40. The throttle valve connector 34 has a tubular wall 36 and, on the inside of the wall 36, has a throttle valve conduit 34*c*. The throttle valve 40, which is symbolically depicted in FIG. 1 and pivotably supported with the aid of the throttle valve shaft 38, is disposed in the throttle valve conduit 34*c*. The throttle valve shaft 38 is supported so that it can rotate in the wall 36 of the throttle valve connector 34. The throttle valve 40 can be adjusted through the use of a likewise symbolically depicted, mechanically and/or electrically functioning adjusting drive 42. The adjusting drive 42 contains, for example, an electric motor with which, by means of a gear not shown in FIG. 1, the throttle valve shaft 38 and the throttle valve 40 fastened to the throttle valve shaft 38 can be adjusted. The adjusting drive 42, though, can also be embodied in the form of a Bowden cable that connects a gas pedal to the throttle valve shaft 38.

The adjusting drive 42 can move the throttle valve 40 of the main conduit throttle mechanism 10 so that the free cross section for the main conduit gas flow 31 is completely or almost completely closed. The throttle valve 40, though, can also be adjusted so that the air or the fuel-air mixture can flow largely unthrottled through the throttle valve conduit 34*c* of the throttle valve connector 34 into the manifold 16. The main conduit gas flow 31 traveling through the main conduit 8 can be controlled by adjusting the throttle valve 40.

A supplementary conduit control mechanism 44 is flange mounted to the throttle valve connector 34 or integrated into the throttle valve connector 34. The supplementary conduit control mechanism 44 symbolically depicted in FIG. 1 has an adjustable valve member 46 symbolically depicted by means of an arrow. The adjusting drive 42 is used for adjusting the throttle valve 40 of the main conduit throttle mechanism 10. The adjusting drive 42 can also move the adjustable valve member 46 of the supplementary conduit control mechanism 44 via a coupling device 50. The supplementary conduit gas flow 32 traveling through the supplementary conduit 12 can be controlled with the adjustment of the valve member 46 of the supplementary conduit control mechanism 44.

Normally an air filter, not shown in the drawings, is disposed on the conduit inlet end 14, in other words, upstream, before the throttle valve connector 34, and filters the gas flow 30 traveling to the internal combustion engine 2. So that no unfiltered air can reach the internal combustion engine 2, and so that an additional air filter is not also required for the supplementary conduit 12, it is preferable if the supplementary conduit 12 branches off from the main conduit 8 downstream, after the air filter on the conduit inlet end 14. In order for the throttle valve 40 to not additionally throttle the supplementary conduit gas flow 32, it is preferable if the supplementary conduit inlet 20 is provided upstream, before the throttle valve 40 so that the supplementary conduit 12 branches off from the main conduit 8 upstream of the throttle valve 40. In order to achieve as favorable an embodiment as possible, it is preferable if the supplementary conduit 12 branches off from the throttle valve connector 34 upstream just before the throttle valve 40 or in the region of the throttle valve 40.

Figure 2:
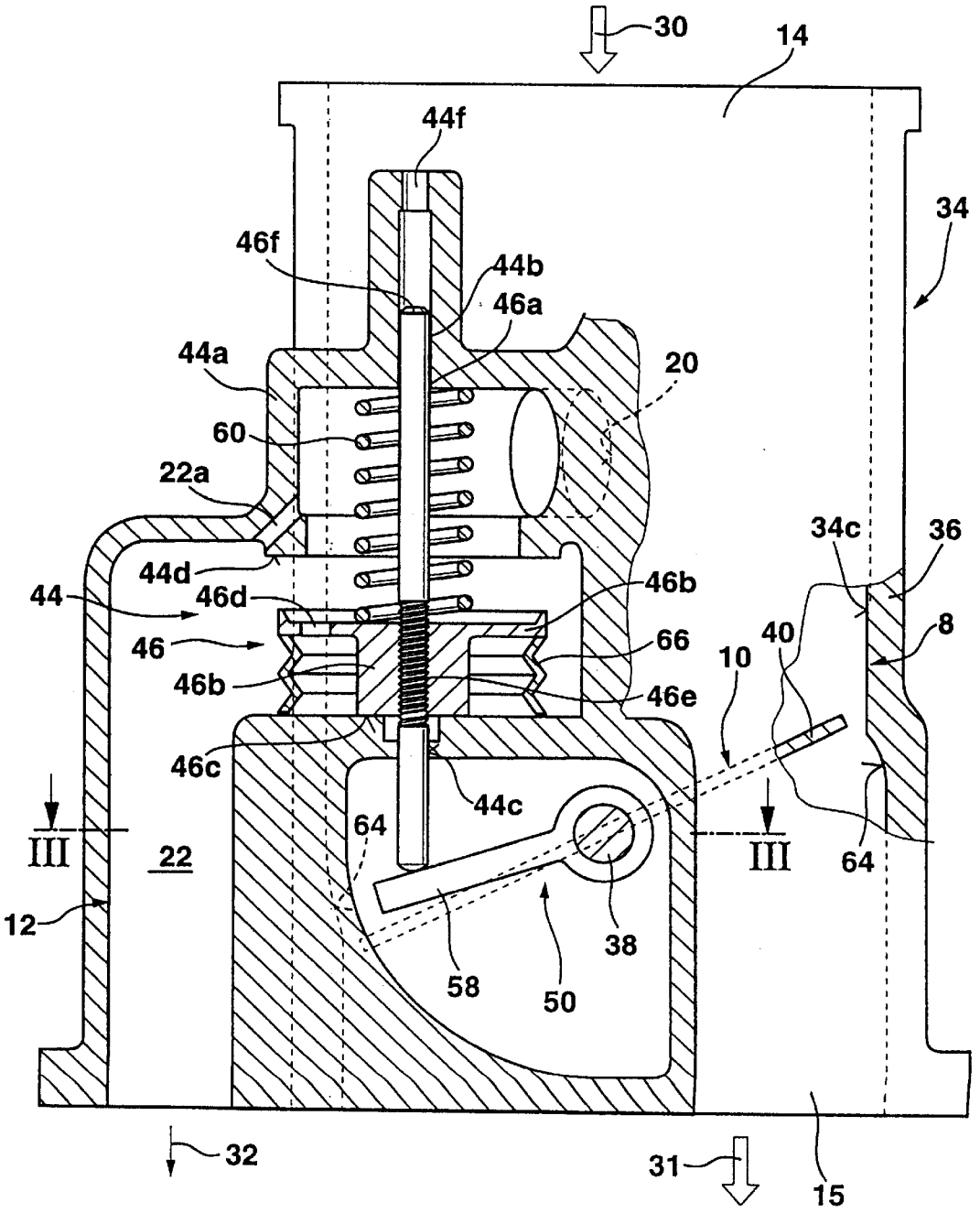
Figure 3:
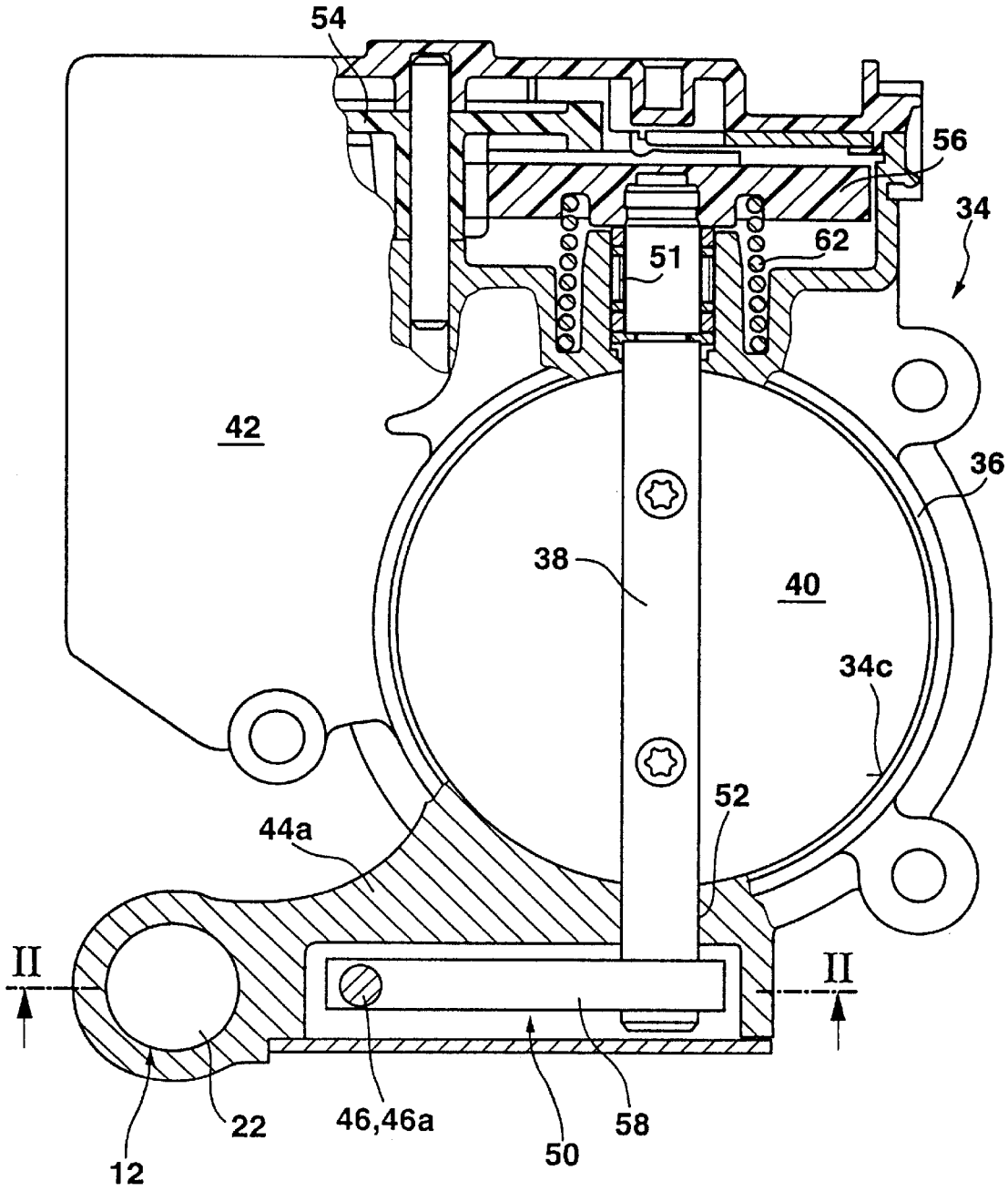

In different scales, FIGS. 2 and 3 show a preferred selected exemplary embodiment that is particularly advantageous and embodied in a modified form, wherein for the sake of clarity, essentially only the region of the throttle valve connector 34 is reproduced here. The intersecting plane represented in FIG. 2 is indicated in FIG. 3 with II—II. In FIG. 3, different regions are represented in section and their intersecting plane and view direction are indicated in FIG. 2 with III—III.

In all of the Figs., the same parts or parts with the same functions are provided with the same reference numerals. Provided that nothing to contradict it is mentioned or represented in the drawings, that which is mentioned and represented in conjunction with one of the Figs. also applies to the other exemplary embodiments. Provided that the explanations do not say otherwise, the details of the different exemplary embodiments can be combined with one another.

The throttle valve shaft 38 extends perpendicular through the throttle valve conduit 34*c* (FIG. 3) and is supported so that it can pivot in the wall 36 of the throttle valve connector 34 with the aid of a first bearing 51 and a second bearing 52.

The adjusting drive 42 (FIG. 3) is preferably comprised essentially of an electric motor built into the throttle valve connector 34. The electric motor drives an intermediary wheel 54. The intermediary wheel 54 meshes with a drive wheel 56, wherein on the side of the first bearing 51, the drive wheel 56 is affixed to the throttle valve shaft 38. On the side of the second bearing 52, a lever 58 is formed onto the throttle valve shaft 38. The lever 58 can adjust the valve member 46 of the supplementary conduit control mechanism 44. In the preferred selected exemplary embodiment, the coupling device 50, which couples the supplementary conduit control mechanism 44 to the movement of the throttle valve 40 or to the adjusting movement of the adjusting drive 42, includes the intermediary wheel 54, the drive wheel 56, the throttle valve shaft 38, the lever 58, and the valve member 46.

The supplementary conduit control mechanism 44 has a housing 44*a* that is connected to the throttle valve connector 34. The housing 44*a* is screw mounted to the throttle valve connector 34 or is preferably cast out of metal or plastic, of one piece with the throttle valve connector 34. In the housing 44*a*, there is a bearing 44*b* and a bearing 44*c* in which the valve member 46 is supported so that it can slide longitudinally. A valve seat 44*d* is provided on the housing 44*a*. The valve member 46 includes a guide rod 46*a*, a closing member 46*b*, and a stop 46*c*. The guide rod 46*a* is supported in the housing 44*a* via the bearings 44*b*, 44*c*.

Depending on the position of the throttle valve 40, the end of the guide rod 46*a* oriented toward the lever 58 rests against the lever 58, wherein the contact point or the contact face between the guide rod 46*a* and the lever 58 is radially spaced from the rotational axis of the throttle valve shaft 38.

Depending on the position of the valve member 46, the closing body 46*b* rests against the valve seat 44*d* or has lifted up from the valve seat 44*d*, wherein the adjusting drive 42 determines the position of the valve member 46 via the coupling device 50 as long as the stop 46*c* does not define the movement end of the valve member 46. A valve spring 60 supported on the housing 44*a* acts on the valve member 46 with its effort applied toward lifting the closing body 46*b* from the valve seat 44*d* until the stop 46*c* comes into contact with the housing 44*a*. The valve spring 60 couples the valve member 46 to the movement of the throttle valve 40 until the stop 46*c* rests against the housing.

A restoring spring 62 supported against the wall 36 of the throttle valve connector 34 acts on the throttle valve 40 via the drive wheel 56 and the throttle valve shaft 38, with its effort applied to actuating the throttle valve 40 in the closing direction. Taking FIG. 2 into consideration, the closing direction corresponds to a rotation of the throttle valve shaft 38 in the clockwise direction. If the electric motor of the adjusting drive 42 is not supplied with current, i.e. when the adjusting drive 42 is not operational, the valve spring 60 has actuated the valve member 46 in the opening direction until the stop 46*c* comes into contact against the housing 44*a* and the restoring spring 62 has actuated the throttle valve 40 in the closing direction until the lever 58 has come into contact with the guide rod 46*a* of the valve member 46. The position just described will be referred to below as the rest position of the valve member 46 of the supplementary conduit control mechanism 44 and of the throttle valve 40 of the main conduit throttle mechanism 10. The force of the valve spring 60 is matched to the force or the torque of the restoring spring 62 so that when the adjusting drive 42 is not operational, the valve member 46 and the throttle valve 40 are securely held in the rest position. FIG. 2 shows the valve member 46 and the throttle valve shaft 38 with the lever 58 and the throttle valve 40 in the rest position. In the rest position of the valve member 46 and the throttle valve 40, the supplementary conduit gas flow 32 can branch off from the gas flow 30 (FIG. 2) at the supplementary conduit inlet 20 and can flow through the supplementary conduit guide 22 to the internal combustion engine 2.

The force or torque of the restoring spring 62 is of sufficient magnitude so that when the adjusting drive 42 is not operational, the throttle valve 40 is adjusted into the rest position by overcoming the frictional forces that occur and overcoming the flow forces acting on the throttle valve 40. The force or torque of the valve spring 60 is of such a magnitude that in the event of a failure of the adjusting drive 42, the valve spring 60 moves the valve member 46, together with the throttle valve 40, until the rest position determined by the stop 46*c*, by overcoming the frictional and flow forces that occur as well as by overcoming the opposing force created by the restoring spring 62 or the opposing torque created by the restoring spring 62. As a result, the rest position of the main conduit throttle mechanism 10 and the supplementary conduit control mechanism 44 is established when the adjusting drive 42 is not operational. With the aid of the adjusting drive 42, though, starting from the rest position, the throttle valve 40, together with the valve member 46, can be moved further in the closing direction till the valve member 46 rests against the housing 44*a*. And starting from the rest position, the adjusting drive 42 can move the throttle valve 40 in the opening direction, wherein the lever 58 lifts up from the valve member 46. The valve spring 60 holds the valve member 46 in the rest position determined by the stop 46*c*, wherein the adjusting drive 42 can overcome this position in the closing direction, wherein the valve member 46 yields in a resilient manner. Viewed in this way, the valve member 46 constitutes a flexible, elastically yielding stop for the throttle valve 40 of the main conduit throttle mechanism 10.

In the selected exemplary embodiment, the throttle valve conduit 34*c* is not embodied in the shape of a continuously straight cylinder, but in the shape of a dome in the region of the throttle valve 40. The throttle valve conduit 34*c* has a dome 64 (FIG. 2) in the region of the throttle valve 40. The dome 64 is shaped so that when the throttle valve 40 is disposed in the rest position, the main conduit gas flow 31 travels through the main conduit 8 with the desired volume. The dome 64 can be shaped so that in the rest position, the supplementary conduit gas flow 32 is greater than the main conduit gas flow 31. In the extreme instance, the main conduit gas flow 31 is zero or close to zero in the rest position.

The corresponding shaping of the dome 64 can achieve the fact that there is a particular ratio between the rotational angle of the throttle valve 40 and the free opening cross section of the main conduit 8. In order to achieve a sensitive adjustment of the free opening cross section of the main conduit 8 in the small opening angle range, preferably the dome 64 is shaped so that to a large extent, the throttle valve conduit 34*c* nestles against the outer circumference of the throttle valve 40 in the small opening angle range.

Starting from the rest position represented in FIG. 2, the adjusting drive 42 can move the throttle valve 40 in the opening direction, which from the point of view depicted in FIG. 2 means a rotation of the throttle valve 40 in the counterclockwise direction. In the course of this, the lever 58 lifts up from the valve member 46 and the valve member 46 remains in the rest position that can be established by the stop 46*c*, in which the supplementary conduit guide 22 is open. The adjusting drive 42 can pivot the throttle valve 40 until the main conduit 8 is completely open.

Starting from the rest position represented in FIG. 2, the adjusting drive 42 (FIG. 3) can also move the throttle valve shaft 38 in the clockwise direction. In the course of this, the adjusting drive 42 moves the valve member 46 toward the valve seat 44*d* via the throttle valve shaft 38 belonging to the coupling device 50 and via the lever 58, until the supplementary conduit guide 22 is completely closed. When necessary, a bore that constitutes a remaining cross section 22*a* can be provided, for example in the closing body 46*b* of the valve member 46 or in the housing 44*a*. The remaining cross section 22*a* makes sure that a minimum quantity of gas can flow through the supplementary conduit guide 22.

If the closing body 46*b* is resting against the valve seat 44*d*, then the valve member 46 of the supplementary conduit control mechanism 44 and the throttle valve 40 of the main conduit throttle mechanism 10 are disposed in a position which will be referred to below as the closed position. For the throttle valve 40, the valve member 46 constitutes the stop that determines the closed position so that for the throttle valve 40, another stop that defines the closed position in another way does not have to be provided. In the closed position, the throttle valve 40 is disposed, for example, perpendicular to the throttle valve conduit 34*c* and the main conduit 8 is completely or almost completely closed.

The coupling device 50 achieves the fact that both the main conduit throttle mechanism 10 and the supplementary conduit control mechanism 44 can be adjusted using the one common adjusting drive 42. A second adjusting drive is not required for this. In the selected exemplary embodiment, in an adjusting region, the throttle valve 40 of the main conduit throttle mechanism 10 and the valve member 46 of the supplementary conduit control mechanism 44 are coupled to each other via the coupling device 50 and in another adjusting region, the throttle valve 40 is adjusted without the valve member 46. In the particularly selected exemplary embodiment, between the rest position and the closed position, the throttle valve 40 and the valve member 46 are moved jointly and between the rest position and the position in which the main conduit 8 is completely open, only the throttle valve 40 is moved, while the valve member 46 rests with the stop 46*c* against the housing 44*a*.

If the movement of the valve member 46 and the throttle valve 40 is considered starting from the closed position, then upon actuation in the opening direction, which according to FIG. 2 means a rotation of the throttle valve shaft 38 in the counterclockwise direction, first the supplementary conduit 12 is opened a relatively large amount and the main conduit 8 then opens a relatively small amount so that in the region of the closed position, the supplementary conduit gas flow 32 is greater or significantly greater than the main conduit gas flow 31. A modulation between the main conduit gas flow 31 and the supplementary conduit gas flow 32 can be easily carried out through the appropriate shaping of the dome 64. Upon further actuation of the valve member 46 and the throttle valve 40, first the supplementary conduit 12 progressively opens to a maximum. At the same time, depending on the shaping of the dome 64, the main conduit 8 opens as well. Upon further actuation of the throttle valve shaft 38 in the opening direction, then the stop 46*c* limits a further opening of the supplementary conduit 12. If the throttle valve 40 is then pivoted further in the opening direction, which according to FIG. 2 means a rotation in the counterclockwise direction, then the lever 58 lifts up from the valve member 46.

The rest position, in which the supplementary conduit 12 and possibly also the main conduit 8 are more or less open, it can thus be determined that the gas flow 30 as a whole is of sufficient volume for an emergency operation of the internal combustion engine 2 to be possible. The emergency operation can, for example, be selected in such a way that the vehicle can be moved far enough for it to reach a repair shop. Even when the vehicle is turned off, the throttle valve 40 is disposed in the rest position, which can be determined in such a way that there is a sufficient gap between the throttle valve 40 and the throttle valve conduit 34*c* so that there is no danger of the throttle valve 40 freezing against the throttle valve conduit 34*c*.

On the end of the closing body 46*b* remote from the valve seat 44*d*, a gas-tight bellows 66 (FIG. 2) is provided, and a bore 46*d* extends through the closing body 46*b*. The diameter of the bellows 66 corresponds approximately to the diameter of the valve seat 44*d*. The bellows 66 and the bore 46*d* are provided for the purpose of pressure compensation so that in particular, even when the supplementary conduit 12 is closed or almost closed, essentially the same pressure prevails on both ends of the closing body 46*b*. As a result, the actuating force that has to be brought to bear for the adjusting drive 42 (FIG. 3) to close the supplementary conduit control mechanism 44 can be significantly reduced.

A thread 46*e* is provided on the guide rod 46*a* and the closing body 46*b* is screwed onto it. There is a wrench face 46*f* on the guide rod 46*a*. The closing body 46*b* is secured against rotation, for example with the aid of the bellows 66 or with another rotational securing device, not shown. Upon rotation at the wrench face 46*f*, the guide rod 46*a* moves in the longitudinal direction in relation to the closing body 46*b* and the stop 46*c* provided on the closing body 46*b* so that in this way, the guide rod 46*a* can be finely adjusted in the longitudinal direction in relation to the closing body 46*b*. By rotating at the wrench face 46*f*, the throttle valve 40 can consequently be adjusted in a simple manner in relation to the valve member 46. In particular, the rest position for the throttle valve 40 can be precisely set in this way. Through the choice of the shaping of the dome 64, the choice of the effective radial distance between the rotational axis of the throttle valve shaft 38 and the engaging point of the valve member 46 on the lever 58, and through the choice of the diameter of the valve seat 44*d*, the ratio of the opening gradient of the supplementary conduit 12 to the opening gradient of the main conduit 8 can be structurally determined. If need be, this ratio can also be changed later within certain limits by rotation at the wrench face 46*f*. By means of an opening 44*f* provided in the housing 44*a*, a rotation at the wrench face 46*f* can subsequently take place, even when the gas delivery system is completely assembled. The opening 44*f* in the housing 44*a* can be closed by means of a closing stopper, not shown.

The foregoing relates to preferred exemplary embodiments of the invention, it being understood that other variants and embodiments thereof are possible within the spirit and scope of the invention, the latter being defined by the appended claims.

I claim:

1. A gas delivery system of an internal combustion engine, comprising at least one combustion chamber, a main conduit (8) for supplying a main conduit gas flow to the at least one combustion chamber, a main conduit throttle mechanism (10) that controls the main conduit gas flow, a supplementary conduit (12) for supplying a supplementary conduit gas flow to the at least one combustion chamber, an adjustable supplementary conduit gas flow, and an adjusting means (42) for adjusting the main conduit throttle mechanism (10) and for adjusting the supplementary conduit control mechanism (44,46), and said main conduit throttle mechanism (10) is acted on in a closing direction by a restoring spring (62) and the supplementary conduit control mechanism (44, 46) is acted on in an opening direction by a valve spring (60).

2. A gas delivery system according to claim 1, in which the supplementary conduit (12, 22) branches off from the main conduit (8) upstream of the main conduit throttle mechanism (10).

3. A gas delivery system according to claim 2, in which the main conduit throttle mechanism (10) is acted on in a closing direction by a restoring spring (62) and the supplementary conduit control mechanism (44, 46) is acted on in an opening direction by a valve spring (60).

4. A gas delivery system according to claim 2, in which a stop (46*c*) limits the adjustability of the supplementary conduit control mechanism (44, 46) in the opening direction.

5. A gas delivery system according to claim 2, in which the main conduit throttle mechanism (10) is embodied in the form of a throttle valve (40), said throttle valve is fastened to a throttle valve shaft (38) that is supported so the throttle valve shaft can pivot in a throttle valve connector (34, 36), wherein the throttle valve shaft (38) is used to adjust the supplementary conduit control mechanism (44, 46).

6. A gas delivery system according to claim 1, in which a stop (46*c*) limits the adjustability of the supplementary conduit control mechanism (44, 46) in the opening direction.

7. A gas delivery system according to claim 1, in which the main conduit throttle mechanism (10) is embodied in the form of a throttle valve (40), said throttle valve is fastened to a throttle valve shaft (38) that is supported so the throttle valve shaft can pivot in a throttle valve connector (34, 36), wherein the throttle valve shaft (38) is used to adjust the supplementary conduit control mechanism (44, 46).

8. A gas delivery system according to claim 1, in which the supplementary conduit control mechanism (44, 46) is used as a flexible stop for the main conduit throttle mechanism (10, 40).

9. A gas delivery system according to claim 1, in which the supplementary conduit control mechanism (44, 46) is used as a flexible stop for the main conduit throttle mechanism (10, 40).

10. A gas delivery system according to claim 9, in which an adjusting movement of the supplementary conduit control mechanism (44, 46) is coupled to an adjusting movement of the main conduit throttle mechanism (10) via a coupling device (50, 58).

11. A gas delivery system according to claim 1, in which an adjusting movement of the supplementary conduit control mechanism (44, 46) is coupled to an adjusting movement of the main conduit throttle mechanism (10) via a coupling device (50, 58).

12. A gas delivery system of an internal combustion engine, comprising at least one combustion chamber, a main conduit (8) for supplying a main conduit gas flow to the at least one combustion chamber, a main conduit throttle mechanism (10) that controls the main conduit gas flow, a supplementary conduit (12) for supplying a supplementary conduit gas flow to the at least one combustion chamber, an adjustable supplementary conduit control mechanism that controls the supplementary conduit gas flow, and an adjusting means (42) for adjusting the main conduit throttle mechanism (10, 40) and for adjusting the supplementary conduit control mechanism (44, 46), the main conduit throttle mechanism (10) is embodied in the form of a throttle valve (40), said throttle valve is fastened to a throttle valve shaft (38) that is supported so the throttle valve shaft can pivot in a throttle valve connector (34, 36), wherein the throttle valve shaft (38) is used to adjust the supplementary conduit control mechanism (44, 46), and the main conduit (8) has a curved enlarged diameter in a region of the throttle valve (40).

13. A gas delivery system according to claim 12, in which the throttle valve (40) is acted upon in the closing direction by a restoring spring (62) and the supplementary conduit control mechanism (44, 46) is acted on in the opening direction by a valve spring (60).

14. A gas delivery system according to claim 2, in which the supplementary conduit control mechanism (44, 46) is used as a flexible stop for the main conduit throttle mechanism (10, 40).

15. A gas delivery system according to claim 14, in which an adjusting movement of the supplementary conduit control mechanism (44, 46) is coupled to an adjusting movement of the main conduit throttle mechanism (10) via a coupling device (50, 58).

16. A gas delivery system of an internal combustion engine, comprising at least one combustion chamber, a main conduit (8) for supplying a main conduit gas flow to the at least one combustion chamber, a main conduit throttle mechanism (10) that controls the main conduit gas flow, a supplementary conduit (12) for supplying a supplementary conduit gas flow to the at least one combustion chamber, an adjustable supplementary conduit control mechanism that controls the supplementary conduit gas flow, and an adjusting means (42) for adjusting the main conduit throttle mechanism (10) and for adjusting the supplementary conduit control mechanism (44, 46), and the supplementary conduit control mechanism (44, 46) provides a flexible stop for the main conduit throttle mechanism (10).

17. A gas delivery system of an internal combustion engine, comprising at least one combustion chamber, a main conduit (8) for supplying a main conduit gas flow to the at least one combustion chamber, a main conduit throttle mechanism (10) that controls the main conduit gas flow, a supplementary conduit (12) for supplying a supplementary conduit gas flow to the at least one combustion chamber, an adjustable supplementary conduit control mechanism that controls the supplementary conduit gas flow, and an adjusting means (42) for adjusting the main conduit throttle mechanism and for adjusting the supplementary conduit control mechanism (44) said supplementary conduit control mechanism (44) includes a guide rod (46*a*), a closing member (46*b*) and a stop (46*c*), said stop (46*c*) limits the adjustability of the supplementary conduit control mechanism (44, 46) in the opening direction and determines a position of repose of the valve member (46), and the main conduit throttle mechanism (10) is adjustable in an opening direction past said position of repose of the valve member (46) without movement of the secondary control device (44).

18. A gas delivery system according to claim 17, in which the main conduit throttle mechanism (10) is embodied in the form of a throttle valve (40), said throttle valve is fastened to a throttle valve shaft (38) that is supported so the throttle valve shaft can pivot in a throttle valve connector (34, 36), wherein the throttle valve shaft (38) is used to adjust the supplementary conduit control mechanism (44, 46).

* * * * *